United States Patent [19]

Sung et al.

[11] 4,409,001

[45] Oct. 11, 1983

[54] GASOLINE COMPOSITIONS CONTAINING AMINO ALKANOIC ACIDS AS DETERGENTS

[75] Inventors: Rodney L. Sung, Fishkill; William M. Sweeney, Wappingers Falls, both of N.Y.; Wheeler C. Crawford, Houston, Tex.

[73] Assignee: Texaco Inc., White Plains, N.Y.

[21] Appl. No.: 338,197

[22] Filed: Jan. 8, 1982

[51] Int. Cl.[3] ..... C10L 1/22

[52] U.S. Cl. ..... 44/71; 252/356

[58] Field of Search ..... 44/71; 252/356

[56] References Cited

U.S. PATENT DOCUMENTS

| | | | |
|---|---|---|---|
| 4,107,096 | 8/1978 | McEntire et al. | 252/356 |
| 4,132,531 | 1/1979 | Cummings et al. | 44/71 |
| 4,290,778 | 9/1981 | Herbstman et al. | 44/71 |
| 4,321,062 | 3/1982 | Herbstman et al. | 44/71 |

*Primary Examiner*—Charles F. Warren
*Assistant Examiner*—Mrs. Y. Harris-Smith
*Attorney, Agent, or Firm*—Carl G. Ries; Robert A. Kulason; Carl G. Seutter

[57] ABSTRACT

Improved gasolines contain, as a detergent additive, (alkyl polyoxyalkyl) amino alkanoic acids such as $$CH_3(CH_2)_{8-10}CH_2(OCH_2\underset{\underset{CH_3}{|}}{C}H)_2NHCH_2CH_2COOH$$

12 Claims, No Drawings

GASOLINE COMPOSITIONS CONTAINING AMINO ALKANOIC ACIDS AS DETERGENTS

FIELD OF THE INVENTION

This invention relates to a fuel composition for internal combustion engines particularly characterized by detergency properties. More particularly it relates to a novel gasoline composition containing a carburetor detergency additive.

BACKGROUND OF THE INVENTION

As is well known to one skilled in the art, contemporary internal combustion engines are increasingly characterized by admission to the intake of the carburetor of (i) blow-by gases from the crank case of the engine and (ii) exhaust gases from the combustion chamber—these design changes being intended to minimize discharge to the atmosphere of undesirable gases. However, these gases commonly contain significent amounts of materials which deposit in and around the throttle plate area of the carburetor resulting in decreased air flow through the carburetor, particularly at low speeds, and an over-rich fuel mixture is formed. This is responsible for stalling or rough engine idling which undesirably increases the amount of polluting gas emissions.

It is an object of this invention to provide a fuel composition characterized by its improved detergency properties. Other objects will be apparent to those skilled in the art.

STATEMENT OF THE INVENTION

In accordance with certain of its aspects, this invention is directed to a motor fuel composition comprising (a) a major portion of fuel containing a hydrocarbon boiling in the gasoline boiling range; and (b) a minor effective amount of, as detergent additive, an (alkyl polyoxyalkyl) amino alkanoic acid.

DESCRIPTION OF THE INVENTION

The base fuel in which the additive of the invention may be used to form a motor fuel composition may comprise a mixture of hydrocarbons boiling in the gasoline boiling range. This base fuel may contain straight chain or branch chain paraffins, cycloparaffins, olefins, and aromatic hydrocarbons and any mixture of these. The base fuel may be derived from straight-chain naphtha, polymer gasoline, natural gasoline, catalytically cracked or themally cracked hydrocarbons, catalytically reformed stocks etc. It may typically boil in the range of about 80°-450° F. Any conventional motor fuel base may be employed in the practice of this invention.

The fuel composition of the invention may contain any of the additives normally employed in a motor fuel. For example, the base fuel may be blended with antiknock compounds, such as tetraalkyl lead compounds, including tetraethyl lead, tetramethyl lead, tetrabutyl lead, etc or cyclopentadienyl manganese tricarbonyl, generally in a concentration from about 0.05 to 4.0 cc. per gallon of gasoline. The tetraethyl lead mixture commercially available for automotive use contains an ethylene chloride-ethylene bromide mixture as a scavenger for removing lead from the combusion chamber in the form of a volatile lead halide. The motor fuel composition may also be fortified with any of the conventional additives including anti-icing additives, corrosion-inhibitors, dyes, etc.

In accordance with practice of this invention, these may be added to a major portion of the fuel, a minor effective amount of, as a detergent additive, an (alkyl polyoxyalkyl) amino alkanoic acid.

Preferably the additive has the formula $$R(OR')_aNR''COOH$$

In the above formula R may be an alkyl group typified by methyl, ethyl, propyl, isopropyl, n-butyl, isobutyl, amyls, hexyls, octyls, etc. R may contain 1-20 carbon atoms, preferably 10-15, more preferably 10-12 carbon atoms.

R' and R'' may be divalent alkylene group containing 1-8 carbon atoms, typically 1-4, say 2-3 carbon atoms. Preferably R' is $—C_2H_4—$ and R'' is $$-CH_2\underset{\underset{CH_3}{|}}{CH}-$$

a maybe 1-20, preferably 1-5, say 1-2.

Illustrative compositions may be the following, the first noted being preferred.

TABLE

| | |
|---|---|
| A | $CH_3(CH_2)_{8-10}CH_2(OCH_2\underset{\underset{CH_3}{\vert}}{CH})_2NHCH_2CH_2COOH$ |
| B | $CH_3(CH_2)_{8-10}CH_2(OCH_2\underset{\underset{CH_3}{\vert}}{CH})_3-NH-CH_2CH_2-COOH$ |
| C | $CH_3(CH_2)_{8-10}CH_2(OCH_2\underset{\underset{CH_3}{\vert}}{CH})_2-NH-CH_2\overset{\overset{CH_3}{\vert}}{CH}-COOH$ |
| D | $CH_3(CH_2)_{8-10}CH_2(OCH_2\underset{\underset{CH_3}{\vert}}{CH})_3NH-CH_2\overset{\overset{CH_3}{\vert}}{CH}-COOH$ |
| E | $CH_3(CH_2)_{8-10}CH_2(OCH_2\underset{\underset{CH_3}{\vert}}{CH})_4NH-CH_2-\underset{\underset{CH_3}{\vert}}{CH}-COOH$ |

These compositions may be commercially available under Jeffamine trademarks typified by Jeffamine Experimental surfactant MA-300. One preferred commercially available product is the first noted in the above table, available under the trademark Jeffamine Surfactant MA-300 (Amphoteric).

It is possible to readily prepare these compositions. For example, the preferred composition may be prepared by the reaction of equimolar portions of acrylic acid with the Jeffamine M-300 brand of $$R(OCH_2\underset{\underset{CH_3}{\vert}}{CH})_xOCH_2\underset{\underset{CH_3}{\vert}}{CH}NH_2$$

wherein R is a mixture of linear C-10 and C-12 alkyl groups and x has the average value of 1.

$$R(OCH_2\underset{\underset{CH_3}{\vert}}{CH})_4OCH_2\underset{\underset{CH_3}{\vert}}{CH}-NH_2 + CH_2{=}CHCOOH$$

-continued $$R(OCH_2\underset{\underset{CH_3}{|}}{C}H)_4OCH_2\underset{\underset{CH_3}{|}}{C}H{-}NHCH_2CH_2COOH$$

In practice of this invention according to certain of its aspects, the additive may be added to the base fuel in minor effective amount. The additives are particularly effective in amount of 0.002-0.2 w % (ca 0.6-64 PTB) of the total fuel composition. Preferred range maybe 0.008-0.1 wt %, (ca 2.7-34 PTB) more preferrable 0.02-0.08 w %, (ca 6.4-27 PTB) say 0.06 w % (ca 20 PTB). PTB stands for pounds per thousand barrels.

It is a feature of this invention that the fuel composition as prepared is characterized by improved carburetor detergency, as tested by the Carburetor Detergency Test—Phase III.

CARBURETOR DETERGENCY TEST—PHASE III

This test is run on a Chevrolet V-8 engine mounted on a test stand using a modified four barrel carburetor. The two secondary barrels of the carburetor are sealed; and the feed to each of the primary barrels is arranged so that simultaneously an additive fuel can be run in one barrel and the reference fuel run in the other. The primary carburetor barrels were modified so that they have removable aluminum inserts (sleeves) in the throttle plate area in order that deposit formed on the inserts in this area could be conveniently weighed.

An unleaded base fuel is first charged to both of the primary barrels and a layer of deposit thus built up on the inserts over 48 hours. The inserts are removed, weighed, and then replaced.

The test proper is then started by charging to one barrel a reference fuel which serves as a standard. The test fuel is admitted to the other barrel of the carburetor.

The engine is run as the feed is admitted to both barrels; engine blow-by is circulated to an inlet in the carburetor body. The test continues for 48 hours.

At the conclusion of the test, the inserts, are removed from the carburetor and weighed to determine the difference between the performance of the additive and reference fuels in removing the preformed deposits.

After the aluminum inserts are cleaned, they are replaced in the carburetor and the process is repeated. First the base fuel is used in both barrels to lay down a predeposited layer and then the reference fuel end the test fuel are admitted. In this second portion of the test, the reference fuel is admitted to the barrel to which the test fuel was admitted the first portion of the test; and the test fuel is admitted to the barrel to which the reference fuel was admitted during the first portion or test. The test continues for 48 hours.

This minimizes differences in fuel distribution and barrel construction.

The deposit weights in the two portions are averaged; and the effectiveness of the fuel composition of the invention is compared to the reference fuel which contains an effective detergent additive. The results are expressed as % removal of the milligrams of deposit previously built up.

The base fuel employed with the detergent additive of the invention in the following examples was a premium grade gasoline having a Research Octane Number of 99. This gasoline consists of about 23% aromatic hydrocarbons, 9% olefinic hydrocarbons and 68% paraffinic hydrocarbons and boiled in the range from 90° to 375° F. The reference fuel contains 60 PTB of a standard prior art carburetor detergent and corrosion inhibitor in the base fuel.

It is found that use of the additives of this invention in the amounts herein designated commonly gives improvements in the Carburetor Detergency Test—Phase III by as much as 106% i.e. it is possible to remove as much as 88 w % of preformed carburetor deposits. In contrast, use of the reference fuels containing a commercial system only permits removal commonly an average of 75 w%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, the reference fuel is an unleaded high test gasoline having an RON of 95.2 and an MON of 86.2. It contains a commercial additive package including 60 PTB of carburetor detergent.

To prepare the test fuel, the reference fuel is made up from the same commercial additive package (but excluding the prior art commercial carburetor detergent additive); and there is added 20 PTB of Jeffamine Experimental Surfactant MA-300 (as carburetor detergent) having the following formula:

$$CH_3(CH_2)_{8-10}CH_2(OCH_2\underset{\underset{CH_3}{|}}{C}H)_2NHCH_2CH_2CH_2COOH.$$

The gasoline formulation so prepared was subjected to the Carburetor Detergency Test—Phase III and the results are tabulated in the table infra. In the Table, R and L indicate respectively Right and Left sleeves.

TABLE

| EXAMPLE | | | Initial Deposit mg | Deposit Removed mg | Rating % Removed |
|---|---|---|---|---|---|
| I | Test | R | 5.1 | 2.7 | 53 |
| | | L | 6.0 | 5.3 | 88 |
| II | Reference | R | 5.4 | 4.3 | 80 |
| | | L | 3.1 | 2.4 | 70 |

From the above table, it is evident that the detergent additive fuel of the present invention is highly effective for removing deposit buildup in an automotive carburetor.

EXAMPLE

Results comparable to those of Example I may be obtained if the additive is

TABLE

| EXAMPLE | ADDITIVE |
|---|---|
| II | $C_{10}H_{21}(OCH_2\underset{\underset{CH_3}{\vert}}{C}H)_2NHCH_2COOH$ |
| III | $C_{11}H_{23}(OCH_2\underset{\underset{CH_3}{\vert}}{C}H)_2NHCH_2CH_2COOH$ |

TABLE-continued

| EXAMPLE | ADDITIVE |
|---|---|
| IV | $C_{12}H_{25}(OCH_2\underset{\underset{CH_3}{\vert}}{C}H)_2NHCH_2CH_2COOH$ |
| V | $C_{10}H_{21}(OCH_2\underset{\underset{CH_3}{\vert}}{C}H)_3NHCH_2CH_2COOH$ |

Although this invention has been illustrated by reference to specific embodiments, it will be apparent to those skilled in the art that various changes and modifications may be made which clearly fall within the scope of this invention.

We claim:

1. A motor fuel composition comprising
(a) a major portion of fuel containing a hydrocarbon boiling in the gasoline boiling range; and
(b) a minor effective amount of, as detergent additive, an (alkyl polyoxyalkyl) amino alkanoic acid.

2. A motor fuel composition as claimed in claim 1 wherein said additive has the formula $$R(OR')_aNR''COOH$$

wherein R is an alkyl hydrocarbon group, R' and R'' are divalent alkylene hydrocarbon groups, and a is 1–20.

3. A motor fuel composition as claimed in claim 1 wherein R is an alkyl group having 4–20 carbon atoms.

4. A motor fuel composition as claimed in claim 1 wherein R' is an alkylene group having 1–8 carbon atoms.

5. A motor fuel composition as claimed in claim 1 wherein R' is $-CH_2CH_2-$.

6. A motor fuel composition as claimed in claim 1 wherein R' is $$-CH_2\underset{\underset{CH_3}{\vert}}{C}H-$$

7. A motor fuel composition as claimed in claim 1 wherein a is 1–4.

8. A motor fuel composition as claimed in claim 1 wherein R'' is a divalent alkylene group containing 1–2 carbon atoms.

9. A motor fuel composition as claimed in claim 1 wherein said effective amount is about 0.002–0.2 wt% of the fuel.

10. A motor fuel composition as claimed in claim 1 wherein said effective amount is about 0.008–0.1 w% of the fuel.

11. A motor fuel composition as claimed in claim 1 wherein said effective amount is about 0.02–0.08 w% of the fuel.

12. A motor fuel composition comprising
(a) a major portion of a hydrocarbon fuel boiling in the gasoline boiling range; and
(b) a minor effective amount, 0.002–0.2 w% of the fuel,
of $$CH_3(CH_2)_{8-10}CH_2(OCH_2\underset{\underset{CH_3}{\vert}}{C}H)_2NHCH_2CH_2COOH.$$

* * * * *